US010162291B2

(12) United States Patent
Saito et al.

(10) Patent No.: US 10,162,291 B2
(45) Date of Patent: Dec. 25, 2018

(54) IMAGE FORMING APPARATUS INCLUDING A TENSION MODIFYING MECHANISM AND A CONTACT AREA ADJUSTMENT MECHANISM

(71) Applicant: Konica Minolta, Inc., Tokyo (JP)

(72) Inventors: Keita Saito, Settsu (JP); Sayaka Morita, Gamagori (JP); Noboru Oomoto, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/453,298

(22) Filed: Mar. 8, 2017

(65) Prior Publication Data

US 2017/0261897 A1 Sep. 14, 2017

(30) Foreign Application Priority Data

Mar. 14, 2016 (JP) ..... 2016-050003

(51) Int. Cl.
*G03G 15/00* (2006.01)
*G03G 15/20* (2006.01)

(52) U.S. Cl.
CPC ..... *G03G 15/2028* (2013.01); *G03G 15/2064* (2013.01); *G03G 15/6591* (2013.01); *G03G 2215/00476* (2013.01); *G03G 2215/2032* (2013.01)

(58) Field of Classification Search
CPC ..... G03G 15/2028
USPC ..... 399/67
See application file for complete search history.

(56) References Cited

U.S. PATENT DOCUMENTS

2006/0165447 A1* 7/2006 Onodera ..... G03G 15/2053 399/329

FOREIGN PATENT DOCUMENTS

JP 2011013591 A 1/2011
JP 2015172613 A 10/2015

* cited by examiner

*Primary Examiner* — Walter L Lindsay, Jr.
*Assistant Examiner* — Ruth Labombard
(74) *Attorney, Agent, or Firm* — Lucas & Mercanti, LLP

(57) ABSTRACT

An image formation apparatus includes: a fixing belt wound on a plurality of support rollers including a first pressure applying roller; a second pressure applying roller applying a pressure to the first pressure applying roller and thus forming a nip portion N; a tension modifying mechanism adjusting a tension; a contact area adjustment mechanism adjusting a downstream contact area, which is a contact area of the fixing belt in contact with the first pressure applying roller that is located downstream of the nip portion N; a sheet information obtainer; and a controller controlling an operation of the tension modifying mechanism and an operation of the contact area adjustment mechanism. When sheet information indicates embossed paper, the controller adjusts the operation of the tension modifying mechanism and the operation of the contact area adjustment mechanism to reduce a tension exerted to the fixing belt and also reduce the downstream contact area.

13 Claims, 12 Drawing Sheets

| BELT ANGLE θ | DOWNSTREAM CONTACT AREA RATIO | AMOUNT OF TONER ADHERING TO SHEET [g/m²] | SEPARABILITY | FIXABILITY |
|---|---|---|---|---|
| −30 | 0.2 | 3.5 | 0.6 | UNSATISFACTORY |
| 0 | 0.6 | 4.8 | 0.9 | GENERALLY SATISFACTORY |
| 30 | 1.0 | 5.6 | 1.0 | SATISFACTORY |

FIG.19

| DOWNSTREAM CONTACT AREA RATIO | FREQUENCY OF OCCURRENCE OF BOUNCING OF BELT |
|---|---|
| 0.2 | LOW |
| 0.4 | ↑ |
| 0.6 | ↕ |
| 0.8 | ↓ |
| 1.0 | HIGH |

IMAGE FORMING APPARATUS INCLUDING A TENSION MODIFYING MECHANISM AND A CONTACT AREA ADJUSTMENT MECHANISM

This application is based on Japanese Patent Application No. 2016-050003 filed with the Japan Patent Office on Mar. 14, 2016, the entire content of which is hereby incorporated by reference.

BACKGROUND OF THE INVENTION

Field of the Invention

The present invention relates to an image formation apparatus including a fixing device which fixes a toner image on a sheet.

Description of the Related Art

In recent years, there is a demand for electrophotographic image formation apparatuses to satisfactorily form images on a variety of storage media. In particular, it is difficult to satisfactorily form an image on embossed paper, and there is a demand for better fixing a toner image to embossed paper.

It is difficult to bring a fixing belt into contact with toner in a recess of embossed paper, and it is difficult to transfer sufficient heat from the fixing belt to the toner in the recess. This results in a toner image poorly fixed to the embossed paper.

An image formation apparatus which can suppress poor fixing of a toner image to embossed paper is disclosed for example in Japanese Laid-Open Patent Publication No. 2015-172613.

The image formation apparatus disclosed in Japanese Laid-Open Patent Publication No. 2015-172613 includes: a tension modifying means that positionally changes a plurality of support rollers on which a fixing belt is wound to modify a tension exerted to the fixing belt; and a unit positionally changing a tension member, that positionally changes the tension member disposed on the side of an inner circumference of the fixing belt upstream of a nip portion to modify a contact area of a pressure applying roller disposed inside the fixing belt and the fixing belt.

In fixing an image on embossed paper, the nip portion has a nip width increased by decreasing a tension exerted to the fixing belt or changing the tension member's position. This helps to bring the fixing belt into contact with the toner in the recess to allow sufficient heat to be transferred to the toner in the recess from the fixing belt. As a result, satisfactory fixing to embossed paper can be obtained.

SUMMARY OF THE INVENTION

However, in the image formation apparatus disclosed in Japanese Laid-Open Patent Publication No. 2015-172613, the tension modifying means modifies the tension exerted to the fixing belt by moving a support roller located on a side different from that of the pressure applying roller. When the tension exerted to the fixing belt is reduced, the fixing belt is loosened from a tensioned state.

When the tension exerted to the fixing belt is reduced without moving the tension member, the fixing belt is loosened in a considerably large amount. In that case, on a side downstream of the nip portion, the loosened portion of the fixing belt contacts a sheet or the like, and poor image quality is a matter of concern.

The present invention has been made in view of the above issue, and an object thereof is to provide an image formation apparatus that can provide satisfactory fixability while suppressing poor image formation resulting from loosening of a fixing belt.

An image formation apparatus reflecting one aspect of the present invention comprises: a plurality of support rollers including a first pressure applying roller; a fixing belt rotatably wound on the plurality of support rollers; a second pressure applying roller applying a pressure to the first pressure applying roller with the fixing belt sandwiched therebetween to form a nip portion between the second pressure applying roller and the fixing belt; a tension modifying mechanism positionally changing at least one of the plurality of support rollers to adjust a tension exerted to the fixing belt; a contact area adjustment mechanism adjusting a downstream contact area, which is a contact area of the fixing belt in contact with the first pressure applying roller that is located downstream of the nip portion; a sheet information obtainer obtaining sheet information of whether a sheet is embossed paper; and a controller controlling an operation of the tension modifying mechanism and an operation of the contact area adjustment mechanism. When sheet information obtained by the sheet information obtainer indicates embossed paper, the controller adjusts the operation of the tension modifying mechanism and the operation of the contact area adjustment mechanism to reduce a tension exerted to the fixing belt and also reduce the downstream contact area.

In the image formation apparatus reflecting one aspect of the present invention as described above, it is preferable that the plurality of support rollers include the first pressure applying roller and a winding roller spaced apart from each other, and that the tension modifying mechanism be configured to be capable of changing a distance between a central axis of the winding roller and a central axis of the first pressure applying roller. In that case, it is preferable that when sheet information obtained by the sheet information obtainer indicates embossed paper, the controller cause the winding roller to approach the first pressure applying roller to reduce the distance between the central axes.

In the image formation apparatus reflecting one aspect of the present invention as described above, the contact area adjustment mechanism may include a movable roller disposed inside the fixing belt between the first pressure applying roller and the winding roller and configured to be movable in a direction traversing the fixing belt, and a movable roller positioning mechanism moving the movable roller. In that case, it is preferable that when sheet information obtained by the sheet information obtainer indicates embossed paper, the controller drive the movable roller positioning mechanism to move the movable roller toward a downstream side in a direction in which a sheet is transported in a state in which the movable roller is caused to abut against an inner circumferential surface of the fixing belt.

In the image formation apparatus reflecting one aspect of the present invention as described above, the contact area adjustment mechanism may include a winding roller positioning mechanism moving the winding roller. In that case, it is preferable that when sheet information obtained by the sheet information obtainer indicates embossed paper, the controller drives the winding roller positioning mechanism to move the winding roller toward a downstream side in a direction in which a sheet is transported.

In the image formation apparatus reflecting one aspect of the present invention as described above, it is preferable that the contact area adjustment mechanism include a second pressure applying roller positioning mechanism moving the second pressure applying roller, and that when sheet information obtained by the sheet information obtainer indicates embossed paper, the controller drives the second pressure applying roller positioning mechanism to move the second pressure applying roller toward a downstream side in a direction in which a sheet is transported such that the second pressure applying roller is moved around the central axis of the first pressure applying roller.

In the image formation apparatus reflecting one aspect of the present invention as described above, it is preferable that when sheet information obtained by the sheet information obtainer does not indicate embossed paper, the winding roller be disposed upstream of the first pressure applying roller in a direction in which a sheet is transported.

In the image formation apparatus reflecting another first aspect of the present invention comprises: a plurality of support rollers including a first pressure applying roller; a fixing belt rotatably wound on the plurality of support rollers; a second pressure applying roller applying a pressure to the first pressure applying roller with the fixing belt sandwiched therebetween to form a nip portion between the second pressure applying roller and the fixing belt; a tension modifying mechanism positionally changing at least one of the plurality of support rollers to adjust a tension exerted to the fixing belt; a contact area adjustment mechanism including a movable roller disposed inside the fixing belt between the first pressure applying roller and another one of the plurality of support rollers and configured to be movable in a direction traversing the fixing belt and a movable roller positioning mechanism moving the movable roller, and adjusting a downstream contact area, which is a contact area of the fixing belt in contact with the first pressure applying roller that is located downstream of the nip portion; a sheet information obtainer obtaining sheet information of whether a sheet is embossed paper; and a controller controlling an operation of the tension modifying mechanism and an operation of the contact area adjustment mechanism. When sheet information obtained by the sheet information obtainer indicates embossed paper, the controller adjusts the operation of the tension modifying mechanism and the operation of the contact area adjustment mechanism to reduce a tension exerted to the fixing belt and also reduce the downstream contact area.

In the image formation apparatus reflecting another first aspect of the present invention as described above, it is preferable that when sheet information obtained by the sheet information obtainer does not indicate embossed paper, the winding roller be disposed upstream of the first pressure applying roller in a direction in which a sheet is transported.

In the image formation apparatus reflecting another second aspect of the present invention comprises: a plurality of support rollers including a first pressure applying roller and a winding roller spaced apart from each other; a fixing belt rotatably wound on the plurality of support rollers; a second pressure applying roller applying a pressure to the first pressure applying roller with the fixing belt sandwiched therebetween to form a nip portion between the second pressure applying roller and the fixing belt; a tension modifying mechanism positionally changing at least one of the plurality of support rollers to adjust a tension exerted to the fixing belt; a contact area adjustment mechanism adjusting a downstream contact area, which is a contact area of the fixing belt in contact with the first pressure applying roller that is located downstream of the nip portion; a sheet information obtainer obtaining sheet information of whether a sheet is embossed paper; and a controller controlling an operation of the tension modifying mechanism and an operation of the contact area adjustment mechanism; the contact area adjustment mechanism including one of a winding roller positioning mechanism moving the winding roller and a second pressure applying roller positioning mechanism moving the second pressure applying roller. When sheet information obtained by the sheet information obtainer indicates embossed paper, the controller adjusts the operation of the tension modifying mechanism and the operation of the contact area adjustment mechanism to reduce a tension exerted to the fixing belt and also reduce the downstream contact area.

In the image formation apparatus reflecting another second aspect of the present invention as described above, it is preferable that when sheet information obtained by the sheet information obtainer does not indicate embossed paper, the winding roller be disposed upstream of the first pressure applying roller in a direction in which a sheet is transported.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 19 indicates for a sheet of embossed paper a relationship between the fixing belt's downstream contact area and a frequency of occurrence of bouncing of the belt at a portion loosened on a side downstream of the nip portion.

DESCRIPTION OF THE PREFERRED EMBODIMENTS

The present invention will now be described in embodiments hereinafter in detail with reference to the drawings. Note that in the following embodiments, identical or common components are identically denoted and will not be described repeatedly. While in the following embodiments a case where an image formation apparatus is a color printer is described by way of example, this is not exclusive, and the image formation apparatus may be a monochrome printer, a fax, or a multi-functional peripheral (MFP) of a monochrome printer, a color printer and a fax.

First Embodiment (Configuration of Image Formation Apparatus)

Figure 1:
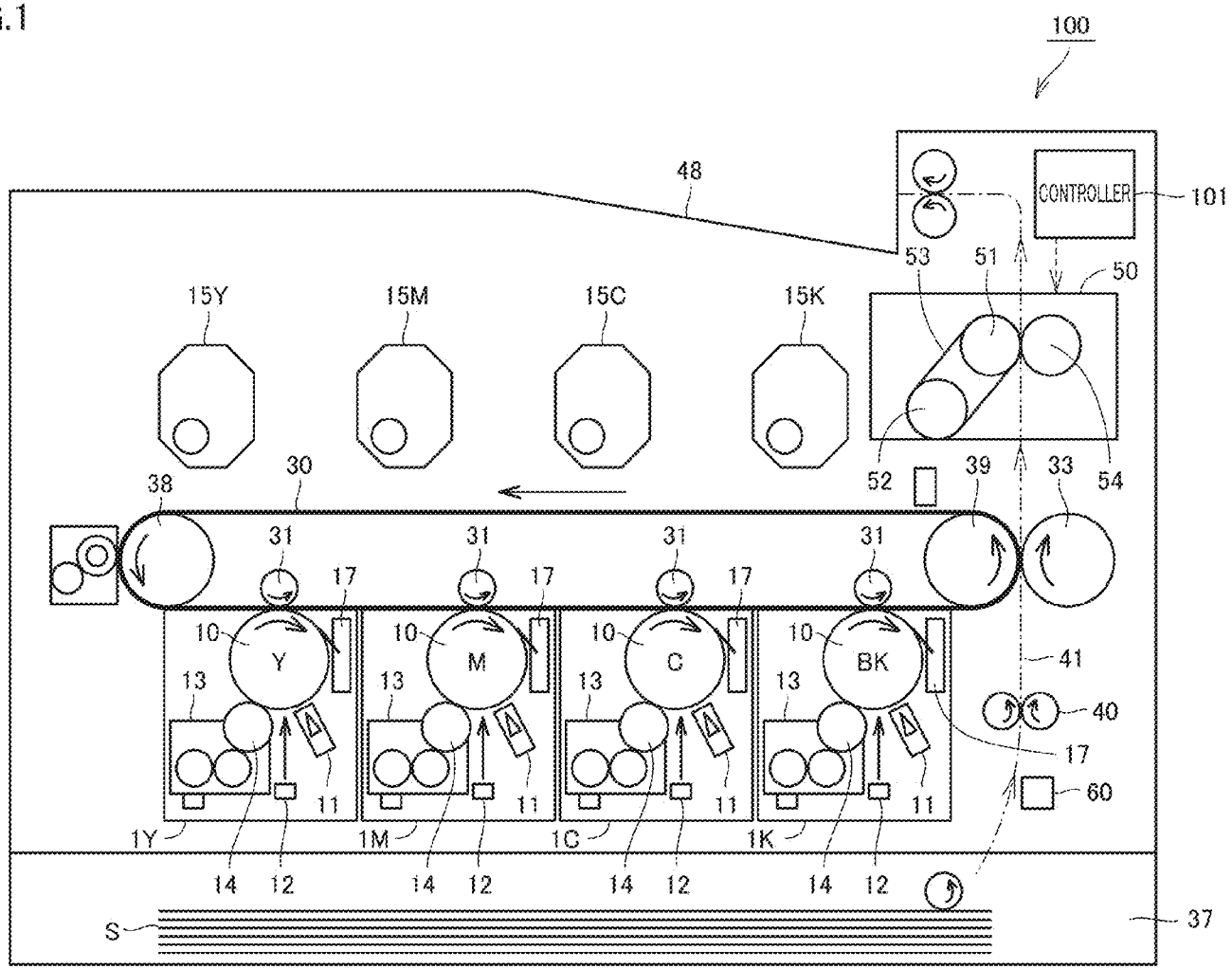
FIG. 1 is a schematic diagram of an image formation apparatus according to a first embodiment.

FIG. 1 is a schematic diagram of an image formation apparatus according to a first embodiment. With reference to FIG. 1, an image formation apparatus 100 according to the first embodiment will be described.

As shown in FIG. 1, according to the first embodiment, image formation apparatus 100 includes image forming units 1Y, 1M, 1C and 1K, an intermediate transfer belt 30, a primary transfer roller 31, a secondary transfer roller 33, a cassette 37, a driven roller 38, a driving roller 39, a timing roller 40, a fixing device 50, and a controller 101.

Image forming units 1Y, 1M, 1C, and 1K are arranged in order along intermediate transfer belt 30. Image forming unit 1Y receives toner supplied from a toner bottle 15Y to form a toner image of yellow (Y). Image forming unit 1M receives toner supplied from a toner bottle 15M to form a toner image of magenta (M). Image forming unit 1C receives toner supplied from a toner bottle 15C to form a toner image of cyan (C). Image forming unit 1K receives toner supplied from a toner bottle 15K to form a toner image of black (BK).

Image forming units 1Y, 1M, 1C, and 1K are disposed along intermediate transfer belt 30 in order in a direction in which intermediate transfer belt 30 rotates. Image forming units 1Y, 1M, 1C, and 1K each include a photoreceptor 10, a charging device 11, an exposure device 12, a developing device 13, and a cleaning device 17.

Charging device 11 charges a surface of photoreceptor 10 uniformly. Exposure device 12 operates in response to a control signal received from controller 101 to irradiate photoreceptor 10 with laser light to expose a surface of photoreceptor 10 to light according to an input image pattern. Thus, an electrostatic latent image depending on an input image is formed on photoreceptor 10.

Developing device 13, while rotating a developing roller 14, applies a developing bias to developing roller 14 and thus causes toner to adhere to a surface of developing roller 14. Thus, the toner is transferred from developing roller 14 to photoreceptor 10, and a toner image depending on an electrostatic latent image is developed on a surface of photoreceptor 10.

Photoreceptor 10 and intermediate transfer belt 30 are in contact with each other at a portion at which a primary transfer roller 31 is provided. Primary transfer roller 31 is provided in the form of a roller and configured to be rotatable. A transferring voltage opposite in polarity to the toner image is applied to primary transfer roller 31 to transfer the toner image from photoreceptor 10 to intermediate transfer belt 30. A toner image of yellow (Y), a toner image of magenta (M), a toner image of cyan (C), and a toner image of black (BK) are superposed on one another in order and thus transferred from photoreceptor 10 to intermediate transfer belt 30. Thus, a color toner image is formed on intermediate transfer belt 30.

Intermediate transfer belt 30 is tensioned and thus engaged on driven roller 38 and driving roller 39. Driving roller 39 is rotatably driven for example by a motor (not shown). Intermediate transfer belt 30 and driven roller 38 are ganged with driving roller 39 and thus rotated. Thus, the toner image on intermediate transfer belt 30 is transported to secondary transfer roller 33.

Cleaning device 17 is pressed into contact with photoreceptor 10. Cleaning device 17 collects toner which remains on a surface of photoreceptor 10 after a toner image is transferred.

A sheet S is set in cassette 37. Sheet S can be embossed paper or regular paper. Sheet S is detected in type by a sheet type detection unit 60 provided on a transport path 41 up to fixing device 50 and serving as a sheet information obtainer. Note that sheet type detection unit 60 may be provided in cassette 37.

Sheet S is sent, one at a time, from cassette 37 by timing roller 40 along transport path 41 to secondary transfer roller 33. Secondary transfer roller 33 is provided in the form of a roller and configured to be rotatable. Secondary transfer roller 33 applies a transferring voltage opposite in polarity to the toner image to sheet S being transported. Thus, the toner image is attracted from intermediate transfer belt 30 to secondary transfer roller 33, and the toner image on intermediate transfer belt 30 is thus transferred. Timing to transport sheet S to secondary transfer roller 33 is adjusted by timing roller 40 in accordance with the position of the toner image on intermediate transfer belt 30. By timing roller 40, the toner image on intermediate transfer belt 30 is transferred to an appropriate position on sheet S.

Fixing device 50 applies pressure to and heat sheet S passing therethrough. Thus, the toner image is fixed to sheet S. Subsequently, sheet S is discharged to a tray 48. Controller 101 is composed of an electric circuit composed of a CPU etc., and controls an operation of the fixing device etc.

Note that while, in the above, image formation apparatus 100 has been described which adopts a tandem system as a printing system, the printing system of image formation apparatus 100 is not limited to the tandem system. The arrangement of each configuration in image formation apparatus 100 may be changed as appropriate according to the printing system adopted. A rotary system, a direct transfer system, and the like may be adopted as a printing system of image formation apparatus 100. In the case of the rotary system, image formation apparatus 100 is composed of a single photoreceptor 10 and a plurality of coaxially rotatably configured developing devices 13. Image formation apparatus 100, when printing, guides each developing device 13 to photoreceptor 10 sequentially to thus develop a toner image of each color. In the case of the direct transfer system, image formation apparatus 100 allows a toner image formed on photoreceptor 10 to be directly transferred to sheet S.

(Configuration of Fixing Device)

Figure 2:
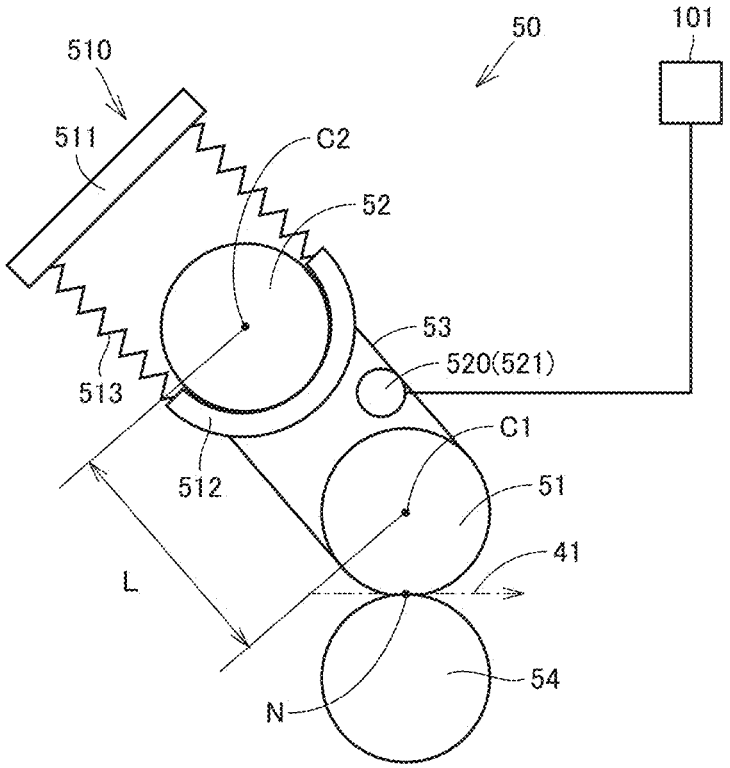
FIG. 2 is a schematic side view of a fixing device of the image formation apparatus according to the first embodiment.
Figure 3:
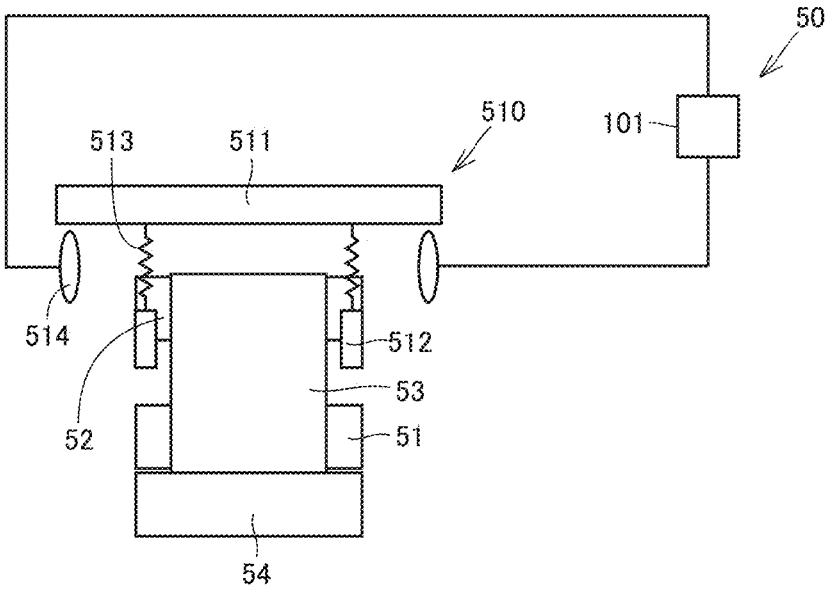
FIG. 3 is a schematic front view of the fixing device of the image formation apparatus according to the first embodiment.

FIG. 2 is a schematic side view of a fixing device of the image formation apparatus according to the first embodiment. FIG. 3 is a schematic front view of the fixing device of the image formation apparatus according to the first embodiment. With reference to FIG. 2 and FIG. 3, fixing device 50 according to the first embodiment will be described.

As shown in FIG. 2 and FIG. 3, fixing device 50 includes a first pressure applying roller 51 and a winding roller 52 serving as a plurality of support rollers, a fixing belt 53, a second pressure applying roller 54, a tension modifying mechanism 510, and a contact area adjustment mechanism 520.

First pressure applying roller 51 and winding roller 52 are spaced from each other. First pressure applying roller 51 is located on the side of transport path 41.

First pressure applying roller 51 has a diameter of about 40 mm to 60 mm. First pressure applying roller 51 is composed for example of a core metal and a surface layer. The core metal is formed of aluminum or iron and is in the form of a pipe. The surface layer is an elastic layer such as silicone rubber for example. The elastic layer has a thickness of about several millimeters.

Winding roller 52 is spaced from transport path 41. Winding roller 52 is disposed upstream of first pressure applying roller 51 in a direction in which sheet S is transported. Winding roller 52 has a diameter of about 40 mm to 60 mm. Winding roller 52 is composed for example of a core metal and a surface layer. The core metal is formed of aluminum or iron and is in the form of a pipe. The surface layer is an elastic layer such as silicone rubber for example. The elastic layer has a thickness of about several millimeters.

Inside winding roller 52 a heat source is provided. As the heat source, a halogen heater can be used for example. Winding roller 52 functions as a heating roller which heats the fixing belt.

Note that the heater is not limited to being provided inside winding roller 52, and it may be provided inside first pressure applying roller 51 or it may be provided inside second pressure applying roller 54.

Fixing belt 53 is a flexible, endless belt. Fixing belt 53 is rotatably wound around first pressure applying roller 51 and winding roller 52. Fixing belt 53 is composed for example of a base layer and an elastic layer. The base layer of fixing belt 53 is composed of polyimide film. The elastic layer of fixing belt 53 is composed of silicone rubber. In a state before it is wound, endless fixing belt 53 has a diameter of about 100 mm.

Second pressure applying roller 54 faces first pressure applying roller 51. Second pressure applying roller 54 applies pressure to first pressure applying roller 51 with fixing belt 53 sandwiched therebetween. This forms a nip portion N between second pressure applying roller 54 and fixing belt 53.

Second pressure applying roller 54 has a diameter of about 40 mm to 60 mm. Second pressure applying roller 54 is composed for example of a core metal and a surface layer. The core metal is formed of aluminum or iron and is in the form of a pipe. The surface layer is an elastic layer such as silicone rubber for example. The elastic layer has a thickness of about several millimeters.

Tension modifying mechanism 510 is configured to be capable of changing a distance between a central axis of winding roller 52 and a central axis of first pressure applying roller 51. Tension modifying mechanism 510 is configured to be capable of moving winding roller 52 in a direction in which a line which connects a center of winding roller 52 and a center of first pressure applying roller 51 extends. By tension modifying mechanism 510, winding roller 52 can be moved by about a maximum of 70 mm for example.

Tension modifying mechanism 510 includes a plate-shaped member 511, a winding roller supporting member 512, a plurality of resilient members 513, and an eccentric cam 514 serving as a tension modifying mechanism driving unit.

Plate-shaped member 511 supports winding roller supporting member 512 via the plurality of resilient members 513. Winding roller supporting member 512 is provided of the sides of the opposite ends of winding roller 52 in the direction of its axis of rotation. Winding roller supporting member 512 has a semicircular shape when it is observed in the direction of the axis of rotation of winding roller 52. Winding roller supporting member 512 supports winding roller 52 rotatably on a side closer to first pressure applying roller 51.

The plurality of resilient members 513 connect plate-shaped member 511 and winding roller supporting member 512. For example, the plurality of resilient members 513 are four resilient members. Two resilient members 513 are disposed on the side of one end of winding roller 52 and that of the other end thereof, respectively. Two resilient members 513 are disposed such that winding roller 52 is located therebetween. The plurality of resilient members 513 are each composed for example of a spring.

Eccentric cam 514 is provided on the sides of the opposite ends of plate-shaped member 511 in the direction of the axis of rotation of winding roller 52. Eccentric cam 514 is driven by controller 101. As eccentric cam 514 rotates, resilient member 513 expands and contracts. As resilient member 513 expands and contracts, winding roller supporting member 512 positionally varies. This changes a distance L between a central axis C2 of winding roller 52 and a central axis C1 of first pressure applying roller 51.

Contact area adjustment mechanism 520 adjusts a contact area of fixing belt 53 in contact with first pressure applying roller 51 that is located downstream of nip portion N (hereinafter also referred to as a downstream contact area). Contact area adjustment mechanism 520 includes a movable roller 521 and a movable roller positioning mechanism 522 (see FIG. 4).

Movable roller 521 is disposed inside fixing belt 53 between first pressure applying roller 51 and winding roller 52. Movable roller 521 is configured to be movable in a direction traversing fixing belt 53. Movable roller 521 is provided to rotate as fixing belt 53 rotate in view of durability relative to rotation of fixing belt 53. Note that movable roller 521 may be provided such that it cannot rotate.

Movable roller positioning mechanism 522 moves movable roller 521. Movable roller positioning mechanism 522 is configured for example by an eccentric cam provided on the sides of the opposite ends of movable roller 521. The eccentric cam is configured rotatably about an axial direction parallel to the direction of the axis of rotation of movable roller 521. When the eccentric cam pivots while pressing an end of movable roller 521, movable roller 521 can be moved.

(Control Configuration of Image Formation Apparatus)

Figure 4:
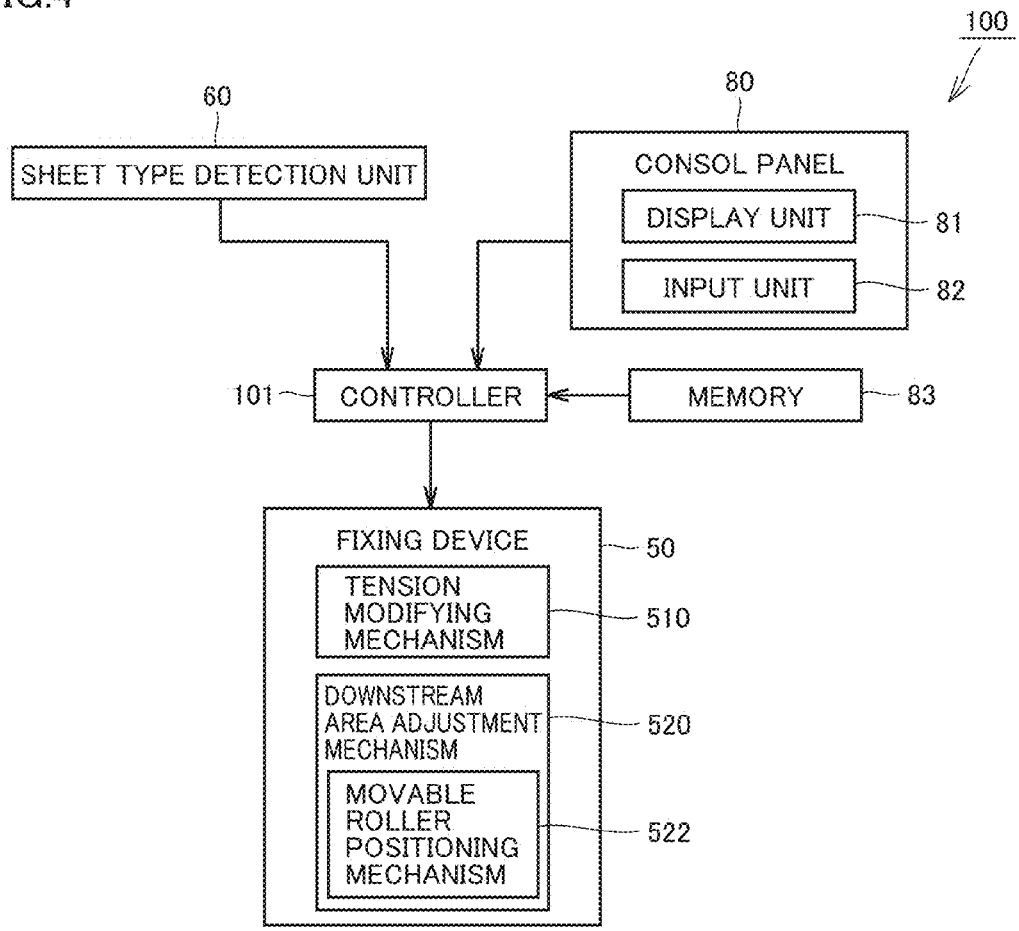
FIG. 4 is a block diagram showing a control configuration of the image formation apparatus according to the first embodiment.

FIG. 4 is a block diagram showing a control configuration of the image formation apparatus according to the first embodiment. With reference to FIG. 4, a control configuration of the image formation apparatus according to the first embodiment will be described.

As shown in FIG. 4, image formation apparatus 100 includes a console panel 80, a memory 83, and sheet type detection unit 60 as a sheet information obtainer.

Console panel 80 includes a display unit 81 which notifies the user of a variety of information, and an input unit 82 which receives a variety of user operations. More specifically, console panel 80 includes various types of input key groups including numerical keys, a touch sensor, etc. as a function of the input unit, and various indicators composed of a liquid crystal display unit integrated with the touch sensor, a light emitting diode (LED), etc. as a function of the display unit.

Sheet type detection unit 60 for example scans a surface of sheet S by an optical method before the sheet reaches fixing device 50, or detects surface roughness etc., to determine whether sheet S is embossed paper. The surface roughness of sheet S can be indexed for example by a difference between a recessed portion and a raised portion.

By detecting the difference between the recessed portion and the raised portion, sheet type detection unit 60 obtains sheet information of whether sheet S is embossed paper. Based on detection information detected by sheet type detection unit 60, controller 101 determines whether sheet S corresponds to embossed paper. For example, controller 101 determines that when the difference between the recessed portion and the raised portion is 50 μm or more, sheet S is embossed paper, and controller 101 determines that when the difference between the recessed portion and the raised portion is less than 50 μm, sheet S is not embossed paper. Based on the detection information received from sheet type detection unit 60, controller 101 controls an operation of tension modifying mechanism 510 and that of contact area adjustment mechanism 520.

Note that while in the above description a case is described by way of example in which information of sheet S is obtained as sheet type detection unit 60 detects a state of a surface of sheet S, this is not exclusive, and console panel 80 operated to perform various operations of the image formation apparatus may function as the sheet information obtainer to obtain information of sheet S.

In that case, the user operates console panel 80 of image formation apparatus 100 to input whether sheet S accommodated in cassette 37 is embossed paper or not (e.g., or regular paper). Thus, based on the input information, controller 101 determines whether sheet S corresponds to embossed paper.

(Operation of Fixing Device)

Figure 5:
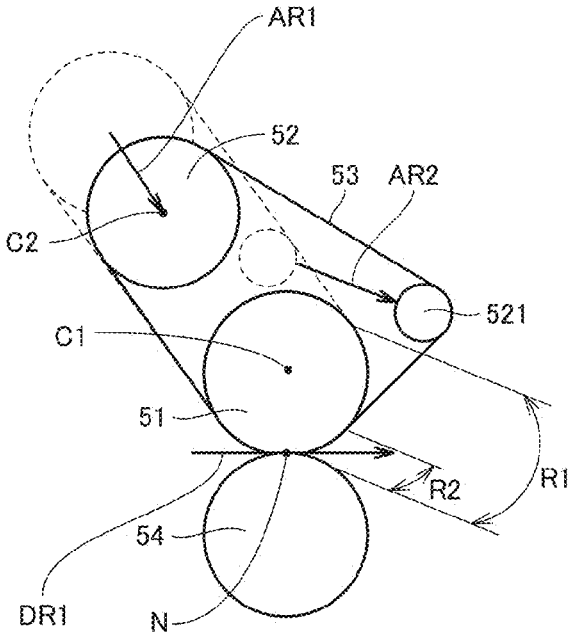
FIG. 5 shows an operation of the fixing device in the image formation apparatus according to the first embodiment for a sheet of embossed paper.

FIG. 5 shows an operation of the fixing device in the image formation apparatus according to the first embodiment for a sheet of embossed paper. Note that, in FIG. 5, a broken line indicates a position of the fixing device for a sheet of regular paper. With reference to FIG. 5, an operation of the fixing device when sheet S is embossed paper will be described.

As shown in FIG. 5, when sheet type detection unit 60 detects that sheet S is embossed paper (i.e., when the sheet information obtainer obtains sheet information indicating embossed paper), controller 101 adjusts tension modifying mechanism 510 and contact area adjustment mechanism 520 to reduce a tension exerted to fixing belt 53 and reduce the downstream contact area.

More specifically, controller 101 causes winding roller 52 to approach first pressure applying roller 51 to reduce a distance between central axis C2 of winding roller 52 and central axis C1 of first pressure applying roller 51 (i.e., a distance between the central axes).

More specifically, controller 101 rotates eccentric cam 514 (see FIG. 3) to reduce a tension exerted by resilient member 513 (see FIG. 3). This allows winding roller supporting member 512 to move to approach first pressure applying roller 51. As winding roller supporting member 512 moves, winding roller 52 moves in a direction indicated by an arrow AR1. This allows winding roller 52 to approach first pressure applying roller 51 and reduces the distance between central axis C2 of winding roller 52 and central axis C1 of first pressure applying roller 51 (i.e., the distance between the central axes). This results in a reduced tension exerted to fixing belt 53 wound on winding roller 52 and first pressure applying roller 51.

Furthermore, controller 101 drives movable roller positioning mechanism 522 to move movable roller 521 toward a downstream side in a direction in which sheet S is transported (i.e., a direction indicated by an arrow DR1) in a state in which movable roller 521 is caused to abut against an inner circumferential surface of fixing belt 53. Note that moving toward a downstream side in the direction in which sheet S is transported means that a component in the direction of the movement includes a component parallel to the direction of the transportation.

When the central axis of winding roller 52 is moved to approach the central axis of first pressure applying roller 51 by about 40 mm, movable roller 521 is moved in the direction of arrow AR2 by about 39 mm for example.

Moving movable roller 521 toward the downstream side in the direction in which sheet S is transported reduces a contact area of fixing belt 53 in contact with first pressure applying roller 51 that is located downstream of nip portion N (i.e., the downstream contact area).

As shown in the figure, a downstream contact area before movable roller 521 is moved is a range indicated by R1, whereas a downstream contact area after movable roller 521 is moved is reduced, as indicated by a range indicated by R2.

Figure 6:
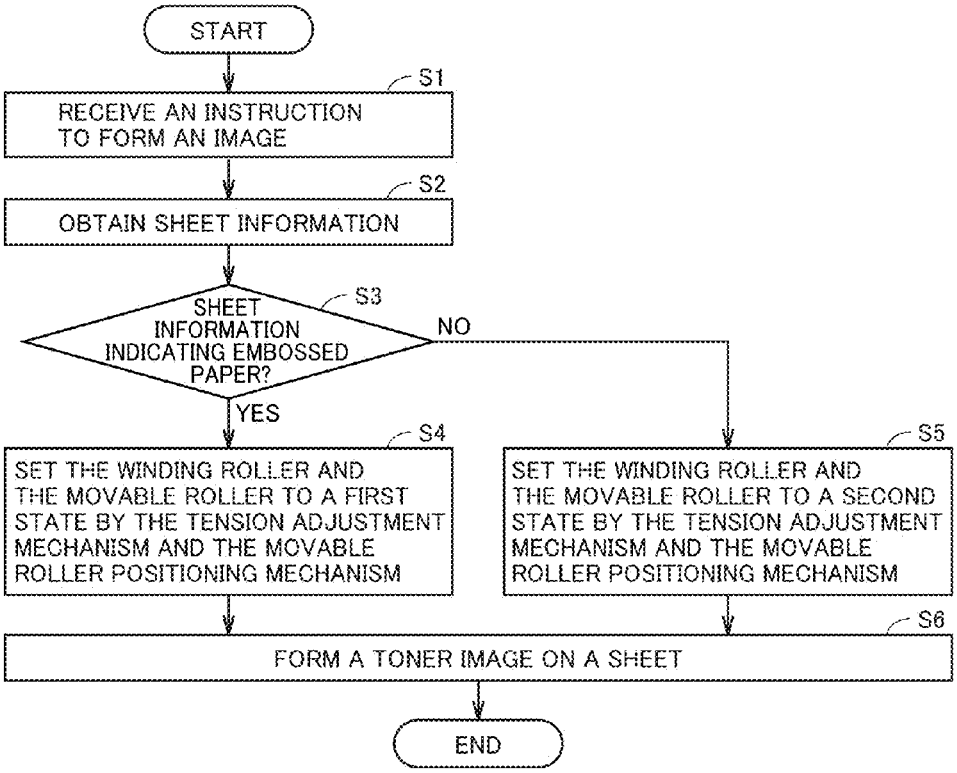
FIG. 6 is a flow chart showing a fixing flow of the image formation apparatus according to the first embodiment.

FIG. 6 is a flow chart showing a fixing flow of the image formation apparatus according to the first embodiment. With reference to FIG. 6, the above described fixing operation will be summarized and described.

As shown in FIG. 6, in forming an image, in step (S1), controller 101 receives an instruction to form an image. In response, sheet S is fed from cassette 37.

Subsequently, in step (S2), sheet type detection unit 60 as a sheet information obtainer detects surface roughness etc. of sheet S transported on a transport path. Detected detection information (sheet information) is input into controller 101.

Note that while in step (S2) a case is described by way of example in which information of sheet S is obtained as sheet type detection unit 60 detects a state of a surface of sheet S, this is not exclusive. For example, the user may operate console panel 80 to select the type of sheet S to allow information of sheet S to be obtained. In that case, step (S2) may be performed simultaneously with or before step (S1).

Subsequently, in step (S3), controller 101 switches a fixing operation based on the input sheet information. When sheet information that sheet S is embossed paper is obtained (step 3; YES), controller 101 performs step (S4). In contrast, when sheet information that sheet S is not embossed paper (specifically, that sheet S is regular paper) is obtained, controller 101 performs step (S5).

In step (S4), controller 101 sets winding roller 52 and movable roller 521 to a first state by tension modifying mechanism 510 and movable roller positioning mechanism 522. The first state is a state in which, as has been described above, winding roller 52 is caused to approach first pressure applying roller 51 and movable roller 521 is moved toward the downstream side in the direction in which sheet S is transported.

In step (S5), controller 101 sets winding roller 52 and movable roller 521 to a second state by tension modifying mechanism 510 and movable roller positioning mechanism 522. The second state is a state in which winding roller 52 is moved away from first pressure applying roller 51 and movable roller 521 is located inside a common tangent of winding roller 52 and first pressure applying roller 51 (a state indicated in FIG. 5 by a broken line).

After step (S4) or step (S5) is performed, in step (S6) fixing device 50 is used to form an image on sheet S.

Thus, in image formation apparatus 100 according to the first embodiment, when sheet information does not indicate embossed paper (more specifically, when the sheet information indicates regular paper), a toner can be fixed to the regular paper in a state in which while a tension exerted to fixing belt 53 is held to be considerably high, the downstream contact area of fixing belt 53 described above is increased. This can suppress adhesion of the toner to fixing belt 53 and thus allows satisfactory fixability to be obtained.

In contrast, when the sheet information indicates embossed paper, the toner can be fixed to the embossed paper in a state in which while a tension exerted to fixing belt 53 is reduced, the downstream contact area of fixing belt 53 described above is reduced.

Loosening fixing belt 53 helps it to easily contact the toner in a recessed portion of embossed paper to transfer sufficient heat to the toner in the recessed portion from fixing belt 53. As a result, satisfactory fixability can be obtained.

In addition, reducing the downstream contact area in fixing belt 53 described above can reduce an amount of loosening of fixing belt 53 downstream of nip portion N. This can prevent a loosened portion of fixing belt 53 from contacting the embossed paper downstream of nip portion N, and hence poor image formation resulting from loosening of the fixing belt.

In particular, in image formation apparatus 100 according to the first embodiment, as will be described hereinafter, poor image formation caused as a loosened portion of the fixing belt bounces can effectively be suppressed.

When tension modifying mechanism 510 is composed of plate-shaped member 511, winding roller supporting member 512, and the plurality of resilient members 513 etc., the position of winding roller supporting member 512 and hence the position of winding roller 52 are adjusted by adjusting a tension of the plurality of resilient members 513. Thus, a distance between winding roller 52 and first pressure applying roller 51 is modified and a tension exerted to fixing belt 53 is modified.

When a tension exerted to fixing belt 53 is weakened without reducing the downstream contact area of fixing belt 53, fixing belt 53 will be loosened downstream of nip portion N in a considerably large amount.

When the fixing belt is loosened in a large amount, a frictional force of the pressure applying roller and the fixing belt decreases. When the frictional force can no longer resist the tension exerted by resilient member 513, resilient member 513 moves winding roller 52 via winding roller supporting member 512 in a direction away from first pressure applying roller 51. This allows a loosened portion of the fixing belt to bounce. This phenomenon results in poor image quality.

Note that in image formation apparatus 100 according to the first embodiment, when sheet S is embossed paper, while tension modifying mechanism 510 is operated to reduce a tension exerted to fixing belt 53, contact area adjustment mechanism 520 is operated to reduce a downstream contact area of fixing belt 53. This can suppress an amount of loosening of fixing belt 53 and suppress reduction of frictional force between first pressure applying roller 51 and fixing belt 53. As a result, bouncing of fixing belt 53 as described above can be suppressed.

Thus, image formation apparatus 100 according to the first embodiment can provide satisfactory fixability while suppressing poor image formation resulting from loosening of a fixing belt.

Second Embodiment (Control Configuration of Image Formation Apparatus)

Figure 7:
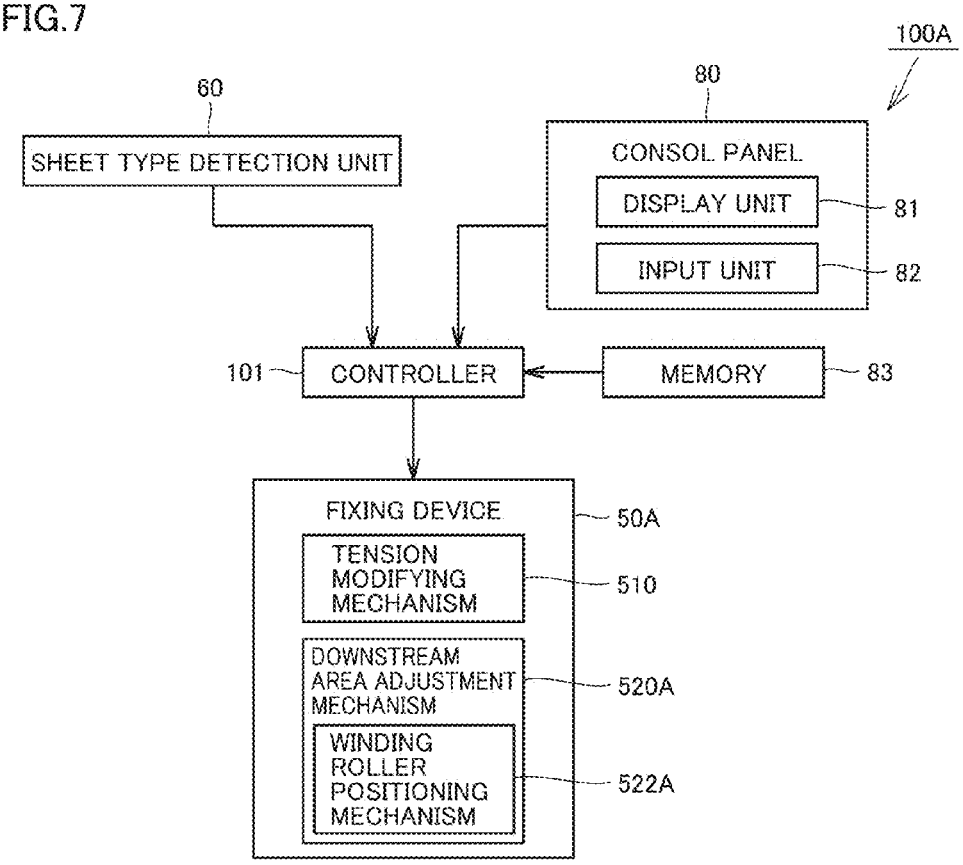
FIG. 7 is a block diagram showing a control configuration of an image formation apparatus according to a second embodiment.

FIG. 7 is a block diagram showing a control configuration of an image formation apparatus according to a second embodiment. With reference to FIG. 7, an image formation apparatus 100A according to the second embodiment will be described.

As shown in FIG. 7, image formation apparatus 100A according to the second embodiment, as compared with image formation apparatus 100 according to the first embodiment, is different in the configuration of a contact area adjustment mechanism 520A. Accordingly, as will be described hereinafter, a fixing device 50A operates differently. The remainder in configuration is substantially similar.

Contact area adjustment mechanism 520A includes a winding roller positioning mechanism 522A moving winding roller 52. Winding roller positioning mechanism 522A is composed of a pressing member which presses the opposite ends of the core bar of winding roller 52 for example.

Note that winding roller positioning mechanism 522A is not limited to the above pressing member, and any configuration that moves winding roller 52 with tension modifying mechanism 510 may be used and for example it may be a movement means to move winding roller supporting member 512.

(Operation of Fixing Device)

Figure 8:
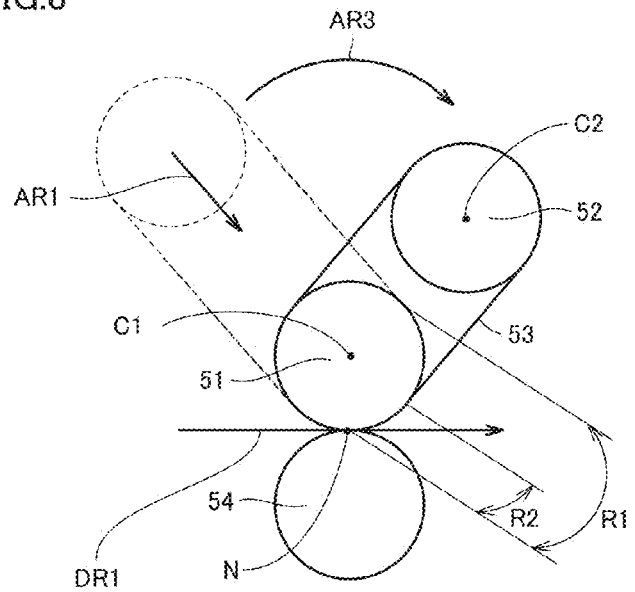
FIG. 8 shows an operation of a fixing device in the image formation apparatus according to the second embodiment for a sheet of embossed paper.

FIG. 8 shows an operation of the fixing device in the image formation apparatus according to the second embodiment for a sheet of embossed paper. Note that, in FIG. 8, a broken line indicates a position of the fixing device for a sheet of regular paper. With reference to FIG. 8, an operation of the fixing device when sheet S is embossed paper will be described.

As shown in FIG. 8, when sheet type detection unit 60 detects that sheet S is embossed paper (i.e., when the sheet information obtainer obtains sheet information indicating embossed paper), controller 101 adjusts tension modifying mechanism 510 and contact area adjustment mechanism 520A to reduce a tension exerted to fixing belt 53 and reduce the downstream contact area.

More specifically, as well as in the first embodiment, controller 101 drives tension modifying mechanism 510 to cause winding roller 52 to approach first pressure applying roller 51 to reduce a distance between central axis C2 of winding roller 52 and central axis C1 of first pressure applying roller 51 (i.e., a distance between the central axes).

Furthermore, controller 101 drives winding roller positioning mechanism 522A to move winding roller 52 toward a downstream side in a direction in which a sheet is transported (i.e., a direction indicated by an arrow DR1). Note that, preferably, winding roller 52 moves about central axis C1 of first pressure applying roller 51, as indicated in the figure by arrow AR3. Thus, when winding roller 52 moves toward a downstream side in the transportation direction, fixing belt 53 can be prevented from loosening and thus being wound at an offset position or coming off first pressure applying roller 51 and winding roller 52.

Moving winding roller 52 toward the downstream side in the direction in which a sheet is transported reduces a contact area of fixing belt 53 in contact with first pressure applying roller 51 that is located downstream of nip portion N (i.e., the downstream contact area).

As shown in the figure, a downstream contact area before winding roller 52 is moved is a range indicated by R1, whereas a downstream contact area after winding roller 52 is moved is reduced, as indicated by a range indicated by R2.

Figure 9:
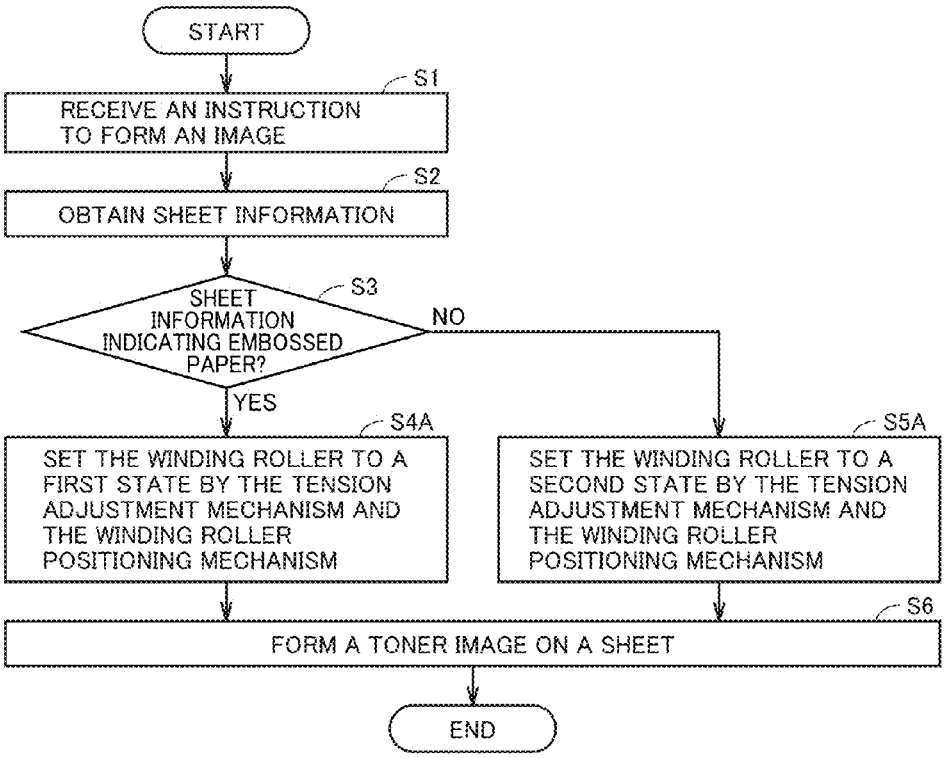
FIG. 9 is a flow chart showing a fixing flow of the image formation apparatus according to the second embodiment.

FIG. 9 is a flow chart showing a fixing flow of the image formation apparatus according to the second embodiment. With reference to FIG. 9, the above described fixing operation will be summarized and described.

As shown in FIG. 8, in forming an image, in step (S1) to step (S3), a process substantially identical to step (S1) to step (S3) in the first embodiment is performed.

In step (S4), controller 101 sets winding roller 52 to a first state by tension modifying mechanism 510 and winding roller positioning mechanism 522A. Note that the first state is a state in which winding roller 52 is caused to approach first pressure applying roller 51 and is also moved toward the downstream side in the direction in which sheet S is transported. In doing so, winding roller 52 is moved from a position upstream of first pressure applying roller 51 in the direction in which sheet S is transported to a position downstream of first pressure applying roller 51 in the direction in which sheet S is transported.

In step (S5), controller 101 sets winding roller 52 to a second state by tension modifying mechanism 510 and winding roller positioning mechanism 522A. Note that the second state is a state in which winding roller 52 is moved away from first pressure applying roller 51 and located upstream of first pressure applying roller 51 in the direction in which sheet S is transported (a state indicated in FIG. 8 by a broken line).

After step (S4) or step (S5) is performed, in step (S6) fixing device 50 is used to form an image on sheet S.

Thus, in image formation apparatus 100A according to the second embodiment, when sheet information does not indicate embossed paper (more specifically, when the sheet information indicates regular paper), a toner can be fixed to the regular paper in a state in which while a tension exerted to fixing belt 53 is held to be considerably high, the downstream contact area of fixing belt 53 described above is increased. This can suppress adhesion of the toner to fixing belt 53 and thus allows satisfactory fixability to be obtained.

In contrast, when sheet S on which an image is to be formed is embossed paper, the toner can be fixed to the embossed paper in a state in which while a tension exerted to fixing belt 53 is reduced, the downstream contact area of fixing belt 53 described above is reduced.

Loosening fixing belt 53 helps it to easily contact the toner in a recessed portion of embossed paper to transfer sufficient heat to the toner in the recessed portion from fixing belt 53. As a result, satisfactory fixability can be obtained.

In addition, reducing the downstream contact area in fixing belt 53 described above can reduce an amount of loosening of fixing belt 53 downstream of nip portion N. This can prevent a loosened portion of fixing belt 53 from contacting the embossed paper downstream of nip portion N, and hence poor image formation resulting from loosening of the fixing belt. Furthermore, as well as in the first embodiment, bouncing of fixing belt 53 can be suppressed.

Thus image formation apparatus 100A according to the second embodiment can also provide an effect substantially equivalent to that of image formation apparatus 100 according to the first embodiment.

Third Embodiment (Control Configuration of Image Formation Apparatus)

Figure 10:
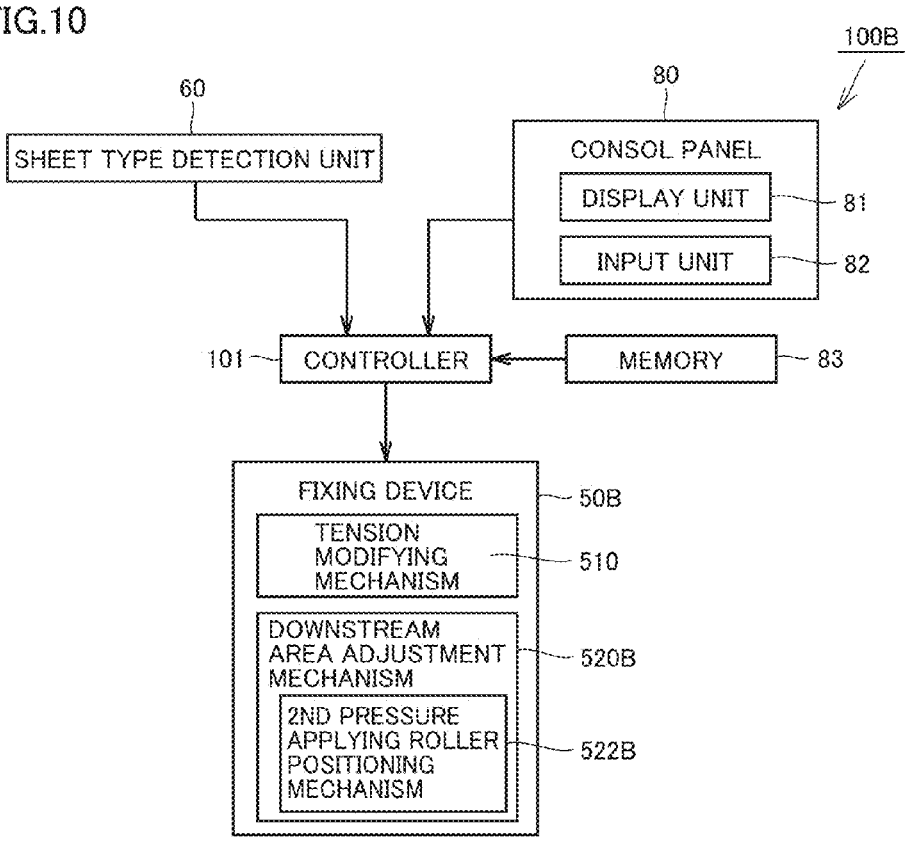
FIG. 10 is a block diagram showing a control configuration of an image formation apparatus according to a third embodiment.

FIG. 10 is a block diagram showing a control configuration of an image formation apparatus according to a third embodiment. With reference to FIG. 10, an image formation apparatus 100B according to the third embodiment will be described.

As shown in FIG. 10, image formation apparatus 100B according to the third embodiment, as compared with image formation apparatus 100 according to the first embodiment, is different in the configuration of a contact area adjustment mechanism 520B. Accordingly, as will be described hereinafter, a fixing device 50B operates differently. The remainder in configuration is substantially similar.

Contact area adjustment mechanism 520B includes a second pressure applying roller positioning mechanism 522B to move second pressure applying roller 54. Second pressure applying roller positioning mechanism 522B is composed of a pressing member which presses the opposite ends of the core bar of second pressure applying roller 54 for example.

(Operation of Fixing Device)

Figure 11:
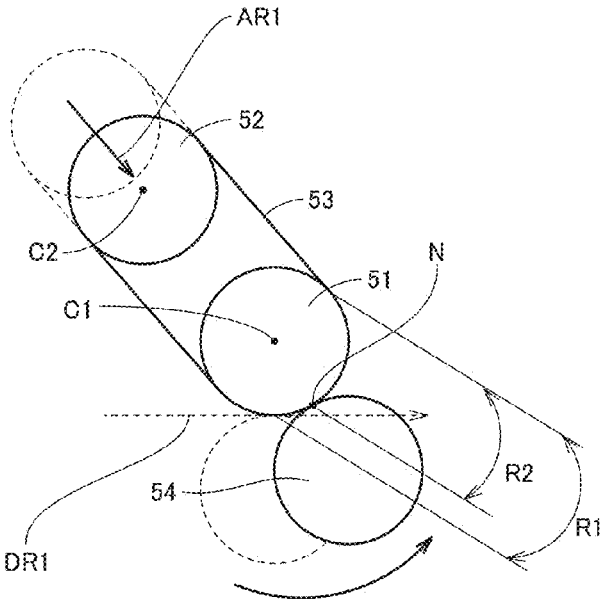
FIG. 11 shows an operation of a fixing device in the image formation apparatus according to the third embodiment for a sheet of embossed paper.

FIG. 11 shows an operation of a fixing device in the image formation apparatus according to the third embodiment for a sheet of embossed paper. Note that, in FIG. 11, a broken line indicates a position of the fixing device for a sheet of regular paper. With reference to FIG. 11, an operation of the fixing device when sheet S is embossed paper will be described.

As shown in FIG. 11, when sheet type detection unit 60 detects that sheet S is embossed paper (i.e., when the sheet information obtainer obtains sheet information indicating embossed paper), controller 101 adjusts tension modifying mechanism 510 and contact area adjustment mechanism 520B to reduce a tension exerted to fixing belt 53 and reduce the downstream contact area.

More specifically, as well as in the first embodiment, controller 101 drives tension modifying mechanism 510 to cause winding roller 52 to approach first pressure applying roller 51 to reduce a distance between central axis C2 of winding roller 52 and central axis C1 of first pressure applying roller 51 (i.e., a distance between the central axes).

Furthermore, controller 101 drives second pressure applying roller positioning mechanism 522B to move second pressure applying roller 54 toward a downstream side in a direction in which a sheet is transported (i.e., a direction indicated by an arrow DR1) such that second pressure applying roller 54 is moved around central axis C1 of first pressure applying roller 51.

This allows second pressure applying roller 54 to be moved while preventing second pressure applying roller 54 from being spaced apart from first pressure applying roller 51 so that a nip portion is no longer formed.

Moving second pressure applying roller 54 as described above reduces a contact area of fixing belt 53 in contact with first pressure applying roller 51 that is located downstream of nip portion N (i.e., the downstream contact area).

As shown in the figure, a downstream contact area before second pressure applying roller 54 is moved is a range indicated by R1, whereas a downstream contact area after second pressure applying roller 54 is moved is reduced, as indicated by a range indicated by R2.

Figure 12:
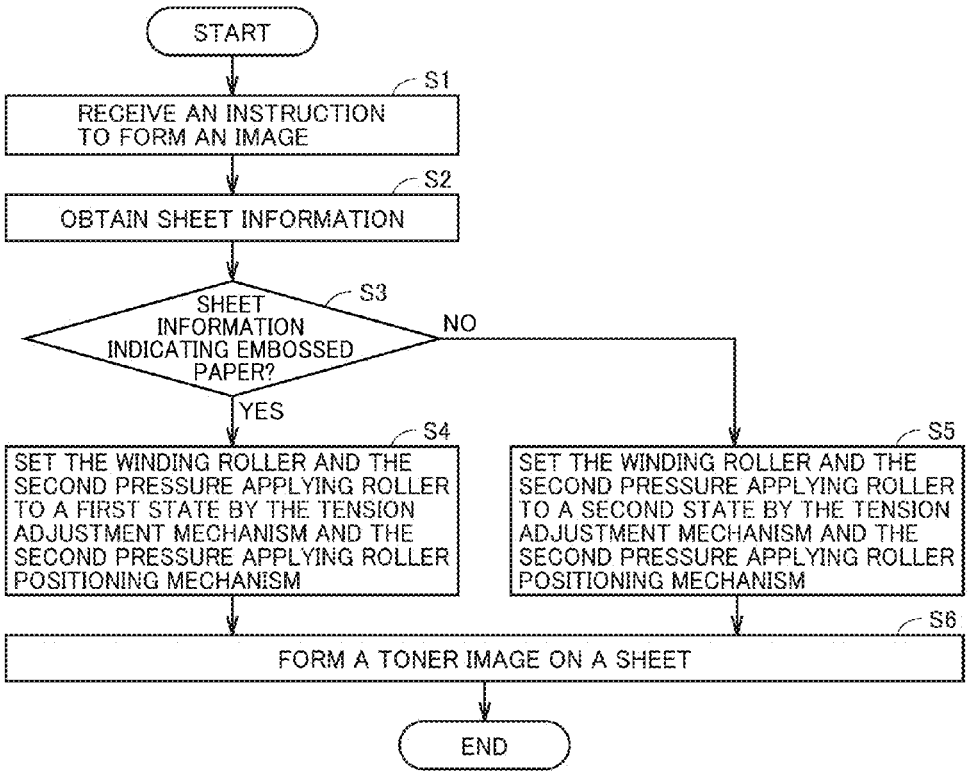
FIG. 12 is a flow chart showing a fixing flow of the image formation apparatus according to the third embodiment.

FIG. 12 is a flow chart showing a fixing flow of the image formation apparatus according to the third embodiment. With reference to FIG. 12, the above described fixing operation will be summarized and described.

As shown in FIG. 12, in forming an image, in step (S1) to step (S3), a process substantially identical to step (S1) to step (S3) in the first embodiment is performed.

In step (S4), controller 101 sets winding roller 52 and second pressure applying roller 54 to a first state by tension modifying mechanism 510 and second pressure applying roller positioning mechanism 522B. Note that the first state is a state in which winding roller 52 is caused to approach first pressure applying roller 51 and second pressure applying roller 54 is moved to a downstream side in the direction in which sheet S is transported such that second pressure applying roller 54 is moved around the central axis of first pressure applying roller 51.

In step (S5), controller 101 sets winding roller 52 and second pressure applying roller 54 to a second state by tension modifying mechanism 510 and second pressure applying roller positioning mechanism 522B. Note that the second state is a state in which winding roller 52 is moved away from first pressure applying roller 51 and located upstream of first pressure applying roller 51 in the direction in which sheet S is transported (a state indicated in FIG. 11 by a broken line).

After step (S4) or step (S5) is performed, in step (S6) fixing device 50 is used to form an image on sheet S.

Thus, in image formation apparatus 100B according to the third embodiment, when sheet information does not indicate embossed paper (more specifically, when the sheet information indicates regular paper), a toner can be fixed to the regular paper in a state in which while a tension exerted to fixing belt 53 is held to be considerably high, the downstream contact area of fixing belt 53 described above is increased. This can suppress adhesion of the toner to fixing belt 53 and thus allows satisfactory fixability to be obtained.

In contrast, when a sheet on which an image is to be formed is embossed paper, the toner can be fixed to the embossed paper in a state in which while a tension exerted to fixing belt 53 is reduced, the downstream contact area of fixing belt 53 described above is reduced.

Loosening fixing belt 53 helps it to easily contact the toner in a recessed portion of embossed paper to transfer sufficient heat to the toner in the recessed portion from fixing belt 53. As a result, satisfactory fixability can be obtained.

In addition, reducing the downstream contact area in fixing belt 53 described above can reduce an amount of loosening of fixing belt 53 downstream of nip portion N. This can prevent a loosened portion of fixing belt 53 from contacting the embossed paper downstream of nip portion N, and hence poor image formation resulting from loosening of the fixing belt. Furthermore, as well as in the first embodiment, bouncing of fixing belt 53 can be suppressed.

Thus image formation apparatus 100B according to the third embodiment can provide an effect substantially equivalent to that of image formation apparatus 100 according to the first embodiment.

Exemplary Experiment (Relationship Between the Fixing Belt's Downstream Contact Area and Fixability for a Sheet of Regular Paper)

Figures 13, 14:
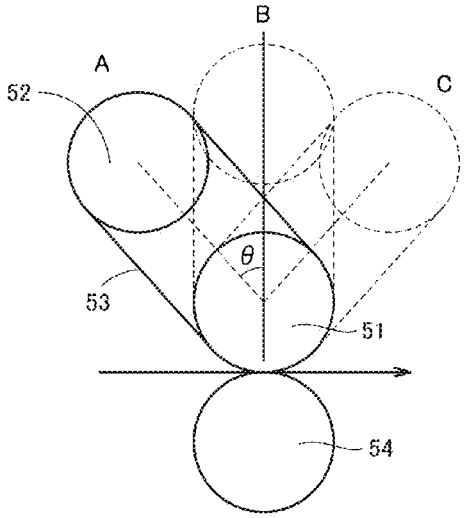
FIG. 13 is a figure for illustrating a relationship between a position of a winding roller and the fixing belt's downstream contact area.
FIG. 14 is a figure illustrating a relationship between the fixing belt's downstream contact area and fixability for a sheet of regular paper.

FIG. 13 is a figure for illustrating a relationship between the winding roller's position and the fixing belt's downstream contact area. FIG. 14 is a figure illustrating a relationship between the fixing belt's downstream contact area and fixability for a sheet of regular paper. With reference to FIG. 13 and FIG. 14, a relationship between a downstream contact area of fixing belt 53 and fixability for a sheet of regular paper, will be described.

As shown in FIG. 13, fixing belt 53 has a downstream contact area varying depending on the position of winding roller 52. As winding roller 52 is positioned toward a downstream side in a direction in which a sheet is transported, fixing belt 53 has a reduced downstream contact area.

The position of winding roller 52 can be determined for example by an angle of inclination θ at which a line passing through a center of first pressure applying roller 51 and a center of winding roller 52 inclines relative to a reference line passing through the center of first pressure applying roller 51 in a vertical direction.

An angle of inclination in a case where the line passing through the center of first pressure applying roller 51 and the center of winding roller 52 inclines upstream relative to the reference line is regarded as a positive angle of inclination, and an angle of inclination in a case where the line passing through the center of first pressure applying roller 51 and the center of winding roller 52 inclines downstream relative to the reference line is regarded as a negative angle of inclination.

As shown in FIG. 14, when a downstream contact area of fixing belt 53 with angle of inclination θ of 30 degrees (i.e., with winding roller 52 at a position A shown in FIG. 13) is represented as 1.0, a downstream contact area of fixing belt 53 with angle of inclination θ of 0 degree (i.e., with winding roller 52 at a position B shown in FIG. 13) will be 0.6, and a downstream contact area of fixing belt 53 with angle of inclination θ of −30 degrees (i.e., with winding roller 52 at a position C shown in FIG. 13) will be 0.2.

Under these three conditions, a toner was fixed using regular paper. Note that the fixation was done without reducing a tension exerted to fixing belt 53. Fixability was evaluated by evaluating an amount of the toner adhering to the regular paper (an amount of adhesion of the toner). The regular paper had a paper weight in grams per square meter of 100 [g/m$^2$].

When angle of inclination θ was −30 degrees, the toner adhered to the sheet in an amount of 3.5 [g/m$^2$], and the toner also adhered to fixing belt 53 in a considerably large amount. Thus the toner was poorly separable from fixing belt 53 and fixability was thus unsatisfactory.

When angle of inclination θ was 0 degree, the toner adhered to the sheet in an amount of 4.8 [g/m$^2$], and the toner also adhered to fixing belt 53, although in a small amount. Accordingly, the toner was generally satisfactorily separable from fixing belt 53, and for fixability, a generally satisfactory result was obtained.

When angle of inclination θ was 30 degrees, the toner adhered to the sheet in an amount of 5.6 [g/m$^2$], and the toner substantially did not adhere to fixing belt 53. Accordingly, the toner was satisfactorily separable from fixing belt 53, and for fixability, a satisfactory result was obtained.

From the above result, it can be said that it has also been confirmed experimentally that satisfactory fixability can be obtained by fixing a toner to regular paper in a state in which while a tension exerted to fixing belt 53 is held to be considerably high, the downstream contact area of fixing belt 53 described above is increased.

(Evaluation of Image Quality when Sheet is Embossed Paper)

In a state where a high tension was exerted to fixing belt 53 and a state where a low tension was exerted to fixing belt 53, a toner was fixed to embossed paper and image quality was evaluated. The embossed paper had a paper weight in grams per square meter of 150 [g/m$^2$].

Figure 15:
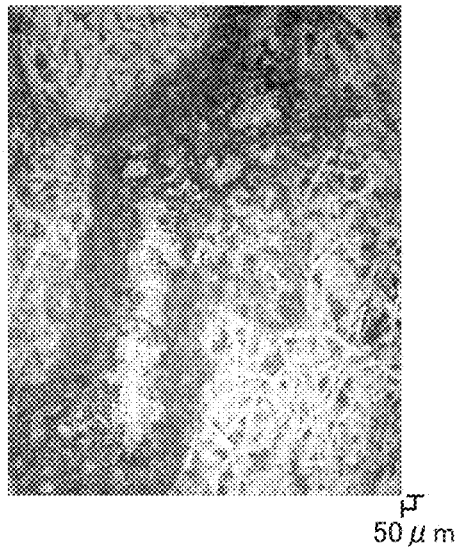
FIG. 15 shows an image when fixing a toner to a sheet of embossed paper with high tension exerted to the fixing belt.
Figure 16:
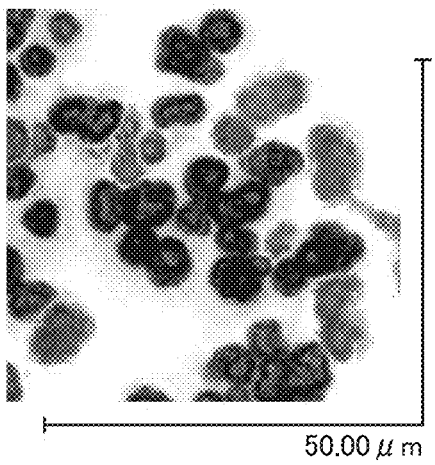
FIG. 16 is an enlarged view of the image shown in FIG. 15.

FIG. 15 shows an image when fixing a toner to a sheet of embossed paper with a high tension exerted to the fixing belt. FIG. 16 is an enlarged view of the image shown in FIG. 15.

As shown in FIG. 15, when the toner was fixed to the embossed paper with a high tension exerted to fixing belt 53, a considerably large void results. As shown in FIG. 16, in a portion of an image surrounding the void, a state where toner particles were molten was confirmed.

Thus, when a high tension was exerted to fixing belt 53, fixing belt 53 does not easily contact a toner disposed in a recessed portion of embossed paper, and thus cannot transfer sufficient heat to the toner in the recessed portion, resulting in a considerably large void.

Figure 17:
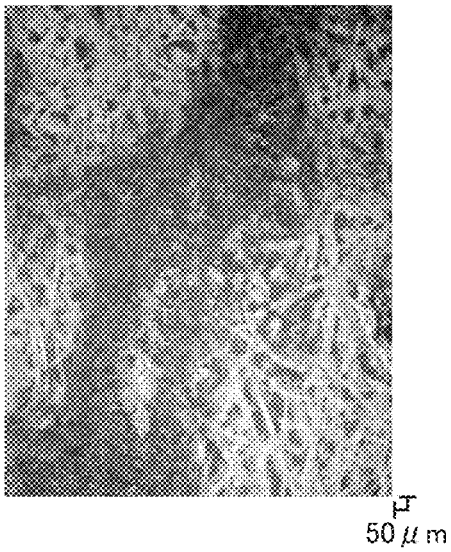
FIG. 17 shows an image when fixing a toner to a sheet of embossed paper with low tension exerted to the fixing belt.
Figure 18:
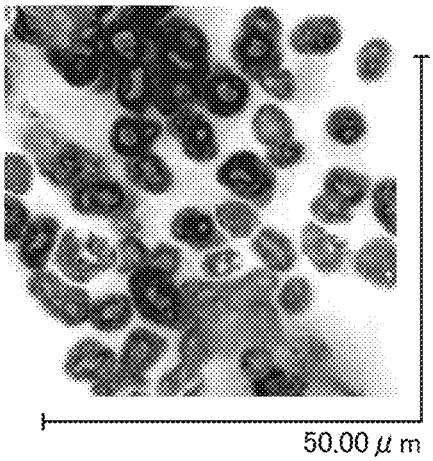
FIG. 18 is an enlarged view of the image shown in FIG. 17.

FIG. 17 shows an image when fixing a toner to a sheet of embossed paper with a low tension exerted to the fixing belt. FIG. 18 is an enlarged view of the image shown in FIG. 17.

As shown in FIG. 17, a case where the toner was fixed to the embossed paper with a low tension exerted to fixing belt 53, as compared with the case where the toner was fixed with a high tension exerted to fixing belt 53, provided a void having a significantly reduced area. As shown in FIG. 18, in a portion of an image surrounding the void, a state where toner particles were molten was confirmed.

Thus, when a low tension was exerted to fixing belt 53, fixing belt 53 easily contacts a toner disposed in a recessed portion of embossed paper, and can thus transfer sufficient heat to the toner in the recessed portion, resulting in a void having a considerably reduced area.

It can be said that it has also been confirmed experimentally that satisfactory fixability can be obtained by fixing a toner to embossed paper in a state with a low tension exerted to fixing belt 53.

FIG. 19 indicates for a sheet of embossed paper a relationship between the fixing belt's downstream contact area and a frequency of occurrence of bouncing of the belt at a portion loosened on a side downstream of the nip portion. With reference to FIG. 19, a relationship between the fixing belt's downstream contact area and a frequency of occurrence of bouncing of the belt at a portion loosened on a side downstream of the nip portion, will be described.

As shown in FIG. 19, a low tension was exerted to fixing belt 53 and in that condition the downstream contact area of fixing belt 53 was varied to confirm the above described frequency of occurrence of bouncing of the belt. The downstream contact area was adjusted by changing angle of inclination θ. In doing so, a downstream contact area of fixing belt 53 for angle of inclination θ of 30 degrees (i.e., with winding roller 52 at position A shown in FIG. 13) is represented as 1.0. The belt bounced less frequently as the downstream contact area of fixing belt 53 was decreased.

From such a result, it can be said that in a state in which a low tension was exerted to fixing belt 53, and by also reducing the downstream contact area in fixing belt 53, satisfactory fixability was able to be obtained while poor image formation attributed to loosening of the fixing belt was suppressed.

More specifically, it can be said that it has also been confirmed experimentally that when the sheet information obtainer obtains sheet information indicating embossed paper, controller 101 can adjust an operation of tension modifying mechanism 510 and that of contact area adjustment mechanism 520 to reduce a tension exerted to fixing belt 53 and also reduce the downstream contact area of fixing belt 53 to provide satisfactory fixability while suppressing poor image formation resulting from loosening of the fixing belt.

Note that while in the first to third embodiments described above a case in which a plurality of support rollers on which fixing belt 53 is wound are first pressure applying roller 51 and winding roller 52 has been illustrated and described, this is not exclusive, and a single or plurality of rollers other than first pressure applying roller 51 and the winding roller may be included. In that case, a tension exerted to fixing belt 53 may be adjusted by moving the single other roller or at least some of the plurality of other rollers.

While the present invention has been described in embodiments, it should be understood that the embodiments disclosed herein are illustrative and non-restrictive in any respect. The scope of the present invention is defined by the terms of the claims, and is intended to include any modifications within the meaning and scope equivalent to the terms of the claims.

What is claimed is:

1. An image formation apparatus comprising:

a plurality of support rollers including a first pressure applying roller;

a fixing belt rotatably wound on the plurality of support rollers;

a second pressure applying roller applying a pressure to the first pressure applying roller with the fixing belt sandwiched therebetween to form a nip portion between the second pressure applying roller and the fixing belt;

a tension modifying mechanism positionally changing at least one of the plurality of support rollers to adjust a tension exerted to the fixing belt;

a contact area adjustment mechanism adjusting a downstream contact area, which is a contact area of the fixing belt in contact with the first pressure applying roller that is located downstream of the nip portion;

a sheet information obtainer obtaining sheet information of whether a sheet is embossed paper; and a controller controlling an operation of the tension modifying mechanism and an operation of the contact area adjustment mechanism;

when sheet information obtained by the sheet information obtainer indicates embossed paper, the controller adjusting the operation of the tension modifying mechanism and the operation of the contact area adjustment mechanism to reduce a tension exerted to the fixing belt and also reduce the downstream contact area.

2. The image formation apparatus according to claim 1, wherein:

the plurality of support rollers include the first pressure applying roller and a winding roller spaced apart from each other;

the tension modifying mechanism is configured to be capable of changing a distance between a central axis of the winding roller and a central axis of the first pressure applying roller; and when sheet information obtained by the sheet information obtainer indicates embossed paper, the controller causes the winding roller to approach the first pressure applying roller to reduce the distance between the central axes.

3. The image formation apparatus according to claim 2, wherein:

the contact area adjustment mechanism includes a movable roller disposed inside the fixing belt between the first pressure applying roller and the winding roller and configured to be movable in a direction traversing the fixing belt, and a movable roller positioning mechanism moving the movable roller; and when sheet information obtained by the sheet information obtainer indicates embossed paper, the controller drives the movable roller positioning mechanism to move the movable roller toward a downstream side in a direction in which a sheet is transported in a state in which the movable roller is caused to abut against an inner circumferential surface of the fixing belt.

4. The image formation apparatus according to claim 2, wherein:

the contact area adjustment mechanism includes a winding roller positioning mechanism moving the winding roller; and when sheet information obtained by the sheet information obtainer indicates embossed paper, the controller drives the winding roller positioning mechanism to move the winding roller toward a downstream side in a direction in which a sheet is transported.

5. The image formation apparatus according to claim 2, wherein:

the contact area adjustment mechanism includes a second pressure applying roller positioning mechanism moving the second pressure applying roller; and when sheet information obtained by the sheet information obtainer indicates embossed paper, the controller drives the second pressure applying roller positioning mechanism to move the second pressure applying roller toward a downstream side in a direction in which a sheet is transported such that the second pressure applying roller is moved around the central axis of the first pressure applying roller.

6. The image formation apparatus according to claim 2, wherein when sheet information obtained by the sheet information obtainer does not indicate embossed paper, the winding roller is disposed upstream of the first pressure applying roller in a direction in which a sheet is transported.

7. The image formation apparatus according to claim 3, wherein when sheet information obtained by the sheet information obtainer does not indicate embossed paper, the winding roller is disposed upstream of the first pressure applying roller in a direction in which a sheet is transported.

8. The image formation apparatus according to claim 4, wherein when sheet information obtained by the sheet information obtainer does not indicate embossed paper, the winding roller is disposed upstream of the first pressure applying roller in a direction in which a sheet is transported.

9. The image formation apparatus according to claim 5, wherein when sheet information obtained by the sheet information obtainer does not indicate embossed paper, the winding roller is disposed upstream of the first pressure applying roller in a direction in which a sheet is transported.

10. An image formation apparatus comprising:

a plurality of support rollers including a first pressure applying roller and a winding roller spaced apart from each other;

a fixing belt rotatably wound on the plurality of support rollers;

a second pressure applying roller applying a pressure to the first pressure applying roller with the fixing belt sandwiched therebetween to form a nip portion between the second pressure applying roller and the fixing belt;

a tension modifying mechanism positionally changing at least one of the plurality of support rollers to adjust a tension exerted to the fixing belt;

a contact area adjustment mechanism including a movable roller disposed inside the fixing belt between the first pressure applying roller and another one of the plurality of support rollers and configured to be movable in a direction traversing the fixing belt and a movable roller positioning mechanism moving the movable roller, and adjusting a downstream contact area, which is a contact area of the fixing belt in contact with the first pressure applying roller that is located downstream of the nip portion;

a sheet information obtainer obtaining sheet information of whether a sheet is embossed paper; and a controller controlling an operation of the tension modifying mechanism and an operation of the contact area adjustment mechanism;

when sheet information obtained by the sheet information obtainer indicates embossed paper, the controller adjusting the operation of the tension modifying mechanism and the operation of the contact area adjustment mechanism to reduce a tension exerted to the fixing belt and also reduce the downstream contact area.

11. The image formation apparatus according to claim 10, wherein when sheet information obtained by the sheet information obtainer does not indicate embossed paper, the winding roller is disposed upstream of the first pressure applying roller in a direction in which a sheet is transported.

12. An image formation apparatus comprising:

a plurality of support rollers including a first pressure applying roller and a winding roller spaced apart from each other;

a fixing belt rotatably wound on the plurality of support rollers;

a second pressure applying roller applying a pressure to the first pressure applying roller with the fixing belt sandwiched therebetween to form a nip portion between the second pressure applying roller and the fixing belt;

a tension modifying mechanism positionally changing at east one of the plurality of support rollers to adjust a tension exerted to the fixing belt;

a contact area adjustment mechanism adjusting a downstream contact area, which is a contact area of the fixing belt in contact with the first pressure applying roller that is located downstream of the nip portion;

a sheet information obtainer obtaining sheet information of whether a sheet is embossed paper; and a controller controlling an operation of the tension modifying mechanism and an operation of the contact area adjustment mechanism;

the contact area adjustment mechanism including one of a winding roller positioning mechanism moving the winding roller and a second pressure applying roller positioning mechanism moving the second pressure applying roller, when sheet information obtained by the sheet information obtainer indicates embossed paper, the controller adjusting the operation of the tension modifying mechanism and the operation of the contact area adjustment mechanism to reduce a tension exerted to the fixing belt and also reduce the downstream contact area.

13. The image formation apparatus according to claim 12, wherein when sheet information obtained by the sheet information obtainer does not indicate embossed paper, the winding roller is disposed upstream of the first pressure applying roller in a direction in which a sheet is transported.

* * * * *